US007946449B2

(12) United States Patent
Benktzon et al.

(10) Patent No.: US 7,946,449 B2
(45) Date of Patent: May 24, 2011

(54) BLISTER PACK DEVICE AND A METHOD OF EJECTING A UNIT DOSAGE FROM A BLISTER PACK USING THE DEVICE

(75) Inventors: Maria Benktzon, Bromma (SE); Sofia Jacobsson, Bromma (SE); Anders Löfgren, Södertälje (SE); Thomas Nilsson, Bromma (SE); Ulrika Vejbrink, Bromma (SE)

(73) Assignee: AstraZeneca AB, Södertälje (SE)

( * ) Notice: Subject to any disclaimer, the term of this patent is extended or adjusted under 35 U.S.C. 154(b) by 463 days.

(21) Appl. No.: 12/093,691

(22) PCT Filed: Nov. 14, 2006

(86) PCT No.: PCT/SE2006/001289

§ 371 (c)(1),
(2), (4) Date: May 14, 2008

(87) PCT Pub. No.: WO2007/058586

PCT Pub. Date: May 24, 2007

(65) Prior Publication Data

US 2010/0193536 A1 Aug. 5, 2010

(30) Foreign Application Priority Data

Nov. 15, 2005 (SE) ..... 0502514

(51) Int. Cl.
*G07F 11/72* (2006.01)

(52) U.S. Cl. ..... 221/31; 221/25; 221/26; 221/30

(58) Field of Classification Search ..... 221/25, 221/26, 30, 31

See application file for complete search history.

(56) References Cited

U.S. PATENT DOCUMENTS

| | | | | |
|---|---|---|---|---|
| 5,009,561 | A * | 4/1991 | Lombardino et al. | 221/25 |
| D317,571 | S | 6/1991 | Henriksson | |
| 5,431,283 | A | 7/1995 | Weinstein et al. | |
| 5,472,115 | A | 12/1995 | Whiton | |
| D367,744 | S | 3/1996 | White | |
| D391,851 | S | 3/1998 | Joergensen | |
| 5,722,563 | A | 3/1998 | Hunts | |
| 5,791,513 | A * | 8/1998 | Intini | 221/30 |
| 5,853,101 | A | 12/1998 | Weinstein | |

(Continued)

FOREIGN PATENT DOCUMENTS

DE 3922763 A1 7/1989

(Continued)

*Primary Examiner* — Timothy R Waggoner

(74) *Attorney, Agent, or Firm* — Finnegan, Henderson, Farabow, Garrett & Dunner, LLP

(57) ABSTRACT

The present invention relates to a blister pack device for dispensing a dosage unit from a blister pack. The blister pack has at least one blister and a lid foil. The device comprises a first arm and a second lever arm hingedly connected to each other, the first arm comprises an aperture through which the dosage unit can be ejected. The lever arm comprises a protruding member for pressing out a dosage unit from the blister when the lever arm is lowered down onto the blister positioned on the first arm. The protruding member comprises a first section for applying a pressing force on the dosage unit inside the blister to initiate the breaking of the lid foil of the blister pack and a second section for distributing the pressing force over the dosage unit and for ejecting the dosage unit.

19 Claims, 5 Drawing Sheets

U.S. PATENT DOCUMENTS

| | | | | |
|---|---|---|---|---|
| 6,206,233 | B1 | 3/2001 | Schulze | |
| D444,361 | S * | 7/2001 | Schulze | D8/51 |
| 6,557,740 | B1 * | 5/2003 | Dent | 221/26 |
| D482,968 | S | 12/2003 | Henriksson | |
| D517,884 | S * | 3/2006 | Ellingwood | D8/51 |
| D533,661 | S * | 12/2006 | Yip | D24/133 |
| 2004/0089577 | A1 | 5/2004 | Kancsar et al. | |
| 2005/0087473 | A1 | 4/2005 | Fabricius et al. | |

FOREIGN PATENT DOCUMENTS

| | | | |
|---|---|---|---|
| EP | 629554 | A1 | 12/1994 |
| EP | 0 759 403 | | 2/1997 |
| GB | 2317587 | A | 1/1998 |
| JP | 3000688 | | 1/1991 |
| WO | WO 03/070598 | A1 | 8/2003 |

* cited by examiner

BLISTER PACK DEVICE AND A METHOD OF EJECTING A UNIT DOSAGE FROM A BLISTER PACK USING THE DEVICE

This is a U.S. National Phase Application of PCT/SE2006/001289, filed Nov. 14, 2006, which claims the benefit of priority to Swedish Application No. 0502514-3, filed Nov. 15, 2005, both of which are hereby incorporated by reference in their entirety.

TECHNICAL FIELD OF THE INVENTION

The present invention relates to a blister pack device and method for dispensing a dosage unit, i.e. a tablet or capsule from a blister pack.

BACKGROUND OF THE INVENTION

Blister packs for drugs in tablet form or in the form of powder or liquid enclosed in a capsule normally incorporate at least one blister part, which consists of a set of interconnected foils covering each other. One relatively rigid foil is in most cases referred to as the base and comprises cavities, so-called open blisters, for accommodating a tablet or a capsule each, while the other foil, which is flat, is in most cases referred to as the lid foil and seals the opening of the cavities or blisters.

For dispensing a tablet or capsule from a blister, the user is required to push the pill or is tablet through the rupturable lid foil. Some blister packs have a design that make them difficult to open and others are intentionally more difficult to open in order to prevent or discourage small children from easily pushing pills out of the blister packs. Most of today's child resistant blister solutions are based on a system, which makes it more difficult for children to press out tablets from the blister. They are made child resistant by using a tough or more resilient lid foil than the standard Al-foil used on normal blister packs. These packs sometimes become very difficult for the average person to open. Further, also blister packs that are relatively easy for the average adult to open, can be difficult to open for a disabled person, elderly people and people with arthritis and other hand impediments.

U.S. Pat. No. 5,791,513 relates to a pill-dispensing device for use in dispensing a capsule from a blister pack. The device comprises first and second members hinged to each other. A blister pack is introduced between the two members and a pusher element projecting from the first member pushes the capsule out from the blister when the first and second elements are closed. A problem with this device is that due to its construction the user needs to apply a significant amount of press force to eject the tablet from the blister. In doing so, there is a risk that the content of the blister is damaged.

In WO03/070598A1, a blister pack device is described which is a device for storing and dispensing a tablet from a blister pack. This device consists of a container having an opening for receiving a blister pack and the container is provided with a dispensing means for ejecting a dosage unit, e.g. a tablet from the blister pack.

THE OBJECT OF THE INVENTION

An object of the present invention is to provide a blister pack device that overcomes or alleviates the drawbacks of the known devices and which provides a blister pack device for effective and accurate dispensing of a dosage unit from a blister pack, particularly from so called child resistant blister packs having a tough lid foil. In this way, the intended user will easily get access to the content of the blister pack but at the same time a high entry barrier is provided for children.

Another object of the present invention is to provide a blister pack device supplying enough force to eject a dosage unit from a blister pack having a tough lid foil, i.e. a child resistant blister pack.

A further object of the present invention is to provide a blister pack device that is simple to use especially for users having some kind of hand impediment.

Another object of the invention is to provide a user friendly device in the sense that it easy to bring with you.

SUMMARY OF THE INVENTION

The present invention provides a blister pack device for dispensing a dosage unit from a blister pack, the blister pack having at least one blister and a lid foil. The device comprises a first arm and a second lever arm hingedly connected to each other, the first arm comprises an aperture through which the dosage unit can be ejected. The lever arm comprises a protruding member for pressing out a dosage unit from the blister pack when the lever arm is lowered down onto a blister positioned on the first arm. The protruding member comprises a first section for applying a pressing force on the dosage unit inside the blister to initiate breaking of the lid foil of the blister pack and a second section for distributing the pressing force over the dosage unit and for ejecting the dosage unit. The main advantage of the present invention is that it provides effective dispensing of a dosage unit from a blister pack, particularly from a child resistant blister pack having a tough lid foil. At the same time, the device is easy to handle by the intended user, as the device is operable without any greater force and the operation of the device is intuitive. Further, by distributing the pressing force over the dosage unit by means of the second section of the protruding member, the risk that the tablet is damaged is reduced.

According to at least one embodiment of the invention, the first section of the protruding is member is provided with a pointed end arranged in the distal end of the protruding member such that when the lever arm is lowered, the pressing force is applied on the outer edge of the blister containing the dosage unit.

By doing this a high initial pressing force is applied to the lid foil via the dosage unit which in turn will break the lid foil. A further advantage of the inventive blister pack device is that it can be operated by using only one hand or it can be placed on e.g. a table and both hands or arms can be used to press on the lever arm for additional force.

According to at least one embodiment of the invention, the area of the pointed end of the protruding member, which faces the blister constitutes approximately ¼ of the protruding member. By using a pointed end a high pressing force can be obtained concentrated to a small area, which makes it easier to initiate the breaking of the lid foil.

According to at least one embodiment of the invention, the second section has an area facing the blister for distributing the pressing force over the dosage unit, which area constitutes approximately ¾ of the protruding member. The proximal part of the area of the second section, i.e. the part of it closest to the hinge, will come in contact with the dosage unit just before the lid foils breaks. As the proximal part of the protruding member makes contact with the dosage unit it will distribute the pressing force over the dosage unit and help to eject the tablet from the blister.

According to at least one embodiment of the invention, the protruding member is arranged on the lever arm such that it fits into the aperture of the first arm when the lever arm is lowered onto the first arm. This means that the protruding member rests within the aperture when the device is in a closed state, i.e. the protruding member is slightly smaller than the width of the aperture. In the closed state the blister pack device is easy to carry with you, for example in a pocket or in a hand bag. Further, the small size of the device makes it easy to incorporate in standard carton packages. Also, the device can be kept in the closed state on the blister pack. A small hole punched into the blister, in between blisters, will function as a parking place for the device, so that it is an integral part of the blister during time of usage, making it less prone to be forgotten or displaced.

According to at least one embodiment of the invention, the first arm comprises a guide means for positioning a blister of the blister pack in line with the aperture as well as in line with the protruding member.

According to at least one embodiment of the invention, the guide means comprises a guide plate provided with a U-shaped indentation partly surrounding the aperture for positioning a blister of the blister pack under the lever arm and over the aperture.

For receiving the blister pack in the right position a gap is preferably provided between the container and the guide plate.

According to at least one embodiment of the invention, the guide plate comprises at least one leg partly surrounding the cavity and fixing a blister in the guide plate. The blister will be properly fixed in the guide plate but the positioning of the blister is at the same time easy with respect to the gap and U-shaped indentation provided in the guide plate.

In a second embodiment of the guide means, the guide means comprises at least one projection in the material of the lower arm arranged to fit into at least one corresponding indentation in the outline of the blister pack for positioning a blister of the blister pack under the lever arm and over the aperture.

According to at least one embodiment of the invention, the guide means of the second embodiment comprises two projections positioned on each side of the aperture in the first arm.

In a third embodiment of the invention, an edge is provided in the lower arm at the distal end of the aperture for initiating a crack in the lid foil of the blister pack. In this way even is less force will be needed to initiate a crack in the lid foil as the edge will be pushed against the lid foil as the pressure is applied on the dosage unit when the lever arm is lowered. Further, such a sharp edge near the aperture may be provided on the first arm regardless the shape of the protruding member of the lever arm.

According to at least one embodiment of the invention, the edge has a pyramidal shape. By making the edge pyramidal it can be made very sharp.

According to at least one embodiment of the invention, the first arm has a ledge arranged along each longside. By providing the first arm with ledges, the device can be place steadily on for example a table. A space is formed under the aperture and the size of the space depends on the height of the ledges. The space under the aperture and the supporting surface, should have enough height to receive the pressed out tablet/capsule.

According to at least one embodiment of the invention, the distance (b) between the protruding member and the distal end of the lever arm is greater than the distance (a) between the protruding member and the hinge.

According to at least one embodiment of the invention, the relationship b/a between the distances a and b has a value between 1.5 and 5.

The lever arm makes it possible to provide enough force on the dosage unit such that even users with weak hands can eject a dosage unit from a blister pack having a tough lid foil, such as a child resistant blister pack.

According to at least one embodiment of the invention, the first arm and the lever arm have substantially the same length.

According to at least one embodiment of the invention, the device is made out of a plastics material.

BRIEF DESCRIPTION OF THE DRAWINGS

The present invention will now be described, for exemplary purposes, in more detail by way of embodiments and with reference to the enclosed drawings, in which.

DESCRIPTION OF PREFERRED EMBODIMENTS

Figure 1:
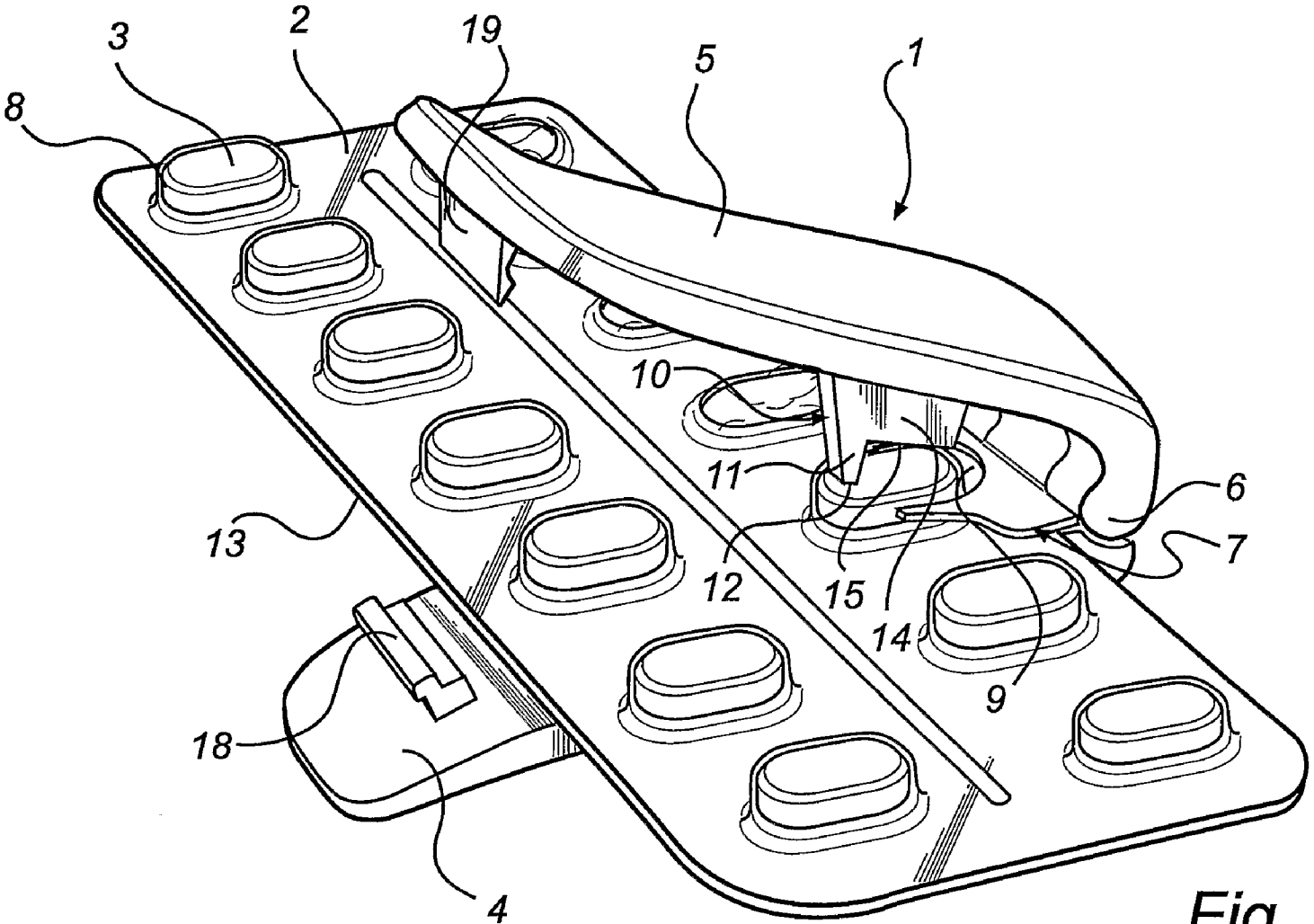
FIG. 1 illustrates a perspective view of the blister pack device with a blister pack positioned for dispensing a dosage unit there from, FIG. 2 illustrates a perspective view of the blister pack device in an open position.

FIG. 1 shows a first embodiment of a blister pack device 1 and a blister pack 2 positioned for dispensing a dosage unit 3 there from. The blister pack has a plurality of blisters 8, for carrying the dosage units and a lid foil 13 sealing the opening of the blisters. The device 1 comprises a first arm 4 and a second lever arm 5 connected to each other via a hinge 6. The hinge can be made as a so-called living hinge made in the same material as the first arm and the lever arm. In this way the first arm, the lever arm and the hinge are made in one piece. However, the hinge can also be constructed by any other known means to hingedly connect two parts. The first arm comprises an aperture 9 (not shown in FIG. 1) through which the dosage unit can be ejected. The lever arm 5 comprises a protruding member 10 for pressing out a dosage unit 3 from the blister when the lever arm is lowered down onto the blister positioned on the first arm. The protruding member comprises a first section 11 for applying a pressing force on the dosage unit inside the blister to initiate breaking of the lid foil 13 of the blister pack. The protruding member also has a second section 14 for distributing the pressing force over the dosage unit and for ejecting the dosage unit from the blister. In the distal end of the protruding member 10 a pointed end is provided. Preferably, the area of the pointed end 12 facing the blister constitutes approximately ¼ of the protruding member. The second section 14 of the protruding member has an area 15 facing the blister for distributing the pressing force over the dosage unit, which area 15 constitutes approximately ¾ of the protruding member.

The first arm further comprises a guide means 7 for positioning a blister of the blister pack in line with the aperture as well as in line with the protruding member. The purpose of the guide means is thus to ensure that the blister of a blister pack is correctly positioned above the aperture as well as under the protruding member and that the blister is fixed in this position until the dosage unit has been pressed out.

The device is further provided with locking means 18, 19 in order to keep the distal ends of the arms together in a locked and closed position when the device is not in use. A first locking means 18 is provided in the distal end of the first arm and a second locking means 19 is provided in the distal end of the lever arm. In a preferred embodiment, as the two arms are put together the locking means simply snap fit into a locked position. However, the lock of the device could be arranged in various ways. For example, a child-resistant locking means could be arranged on the device, to make the device more difficult to open for children but made in a way making it obvious for adults to open.

Figure 2:
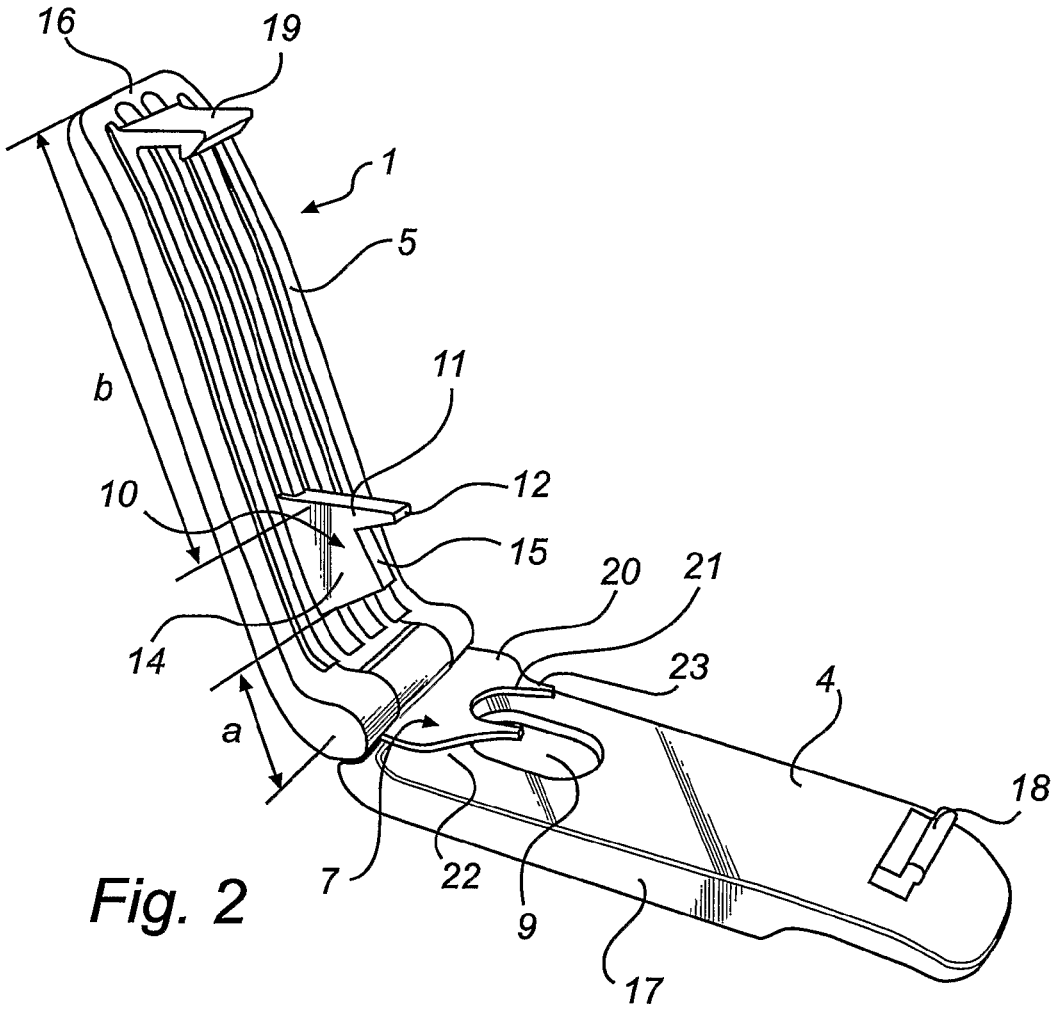

FIG. 2 shows the device of FIG. 1 but without the blister pack. The aperture 9 for receiving the dosage unit when it is pushed out from the blister is clearly shown in the first arm 4. The aperture is shown as an elliptical opening but any other shape of the aperture is possible, as the aperture has to correspond to the size and shape of the dosage unit to be pushed out from a blister. In this first embodiment of the device the guide means 7 comprises a guide plate 20 for positioning the blister pack correctly before lowering the lever arm to press out the dosage unit. Between the first arm 4 and the guide plate 20 there is gap 22 for receiving the blister pack. The guide plate has a U-shaped indentation 21 such that two legs 23 are formed on each side of the aperture 9, which legs positions and fixes the blister in a correct position. The U-shaped indentation can have any other shape as long is as its shape corresponds to the shape of the aperture. The first arm is provided with ledges 17, one on each side of the first arm such that the device can lay stable on for example a table or other flat surface. By placing the device on a table, a patient can push out a tablet using both hands to press on the lever for additional force. The protruding member 10 should be positioned such that enough force is developed from the lever arm such that persons with weak hands also can use the device successfully. The distances a and b are shown in FIG. 2, where a is the distance between the protruding member 10 and the hinge 6 and b is the distance between the protruding member and distal end 16 of the lever arm. The relationship b/a between the distances a and b should be 1.5 to 5 in order to develop enough force with the lever arm to break for example a tough child resistant lid foil.

Figure 3A:
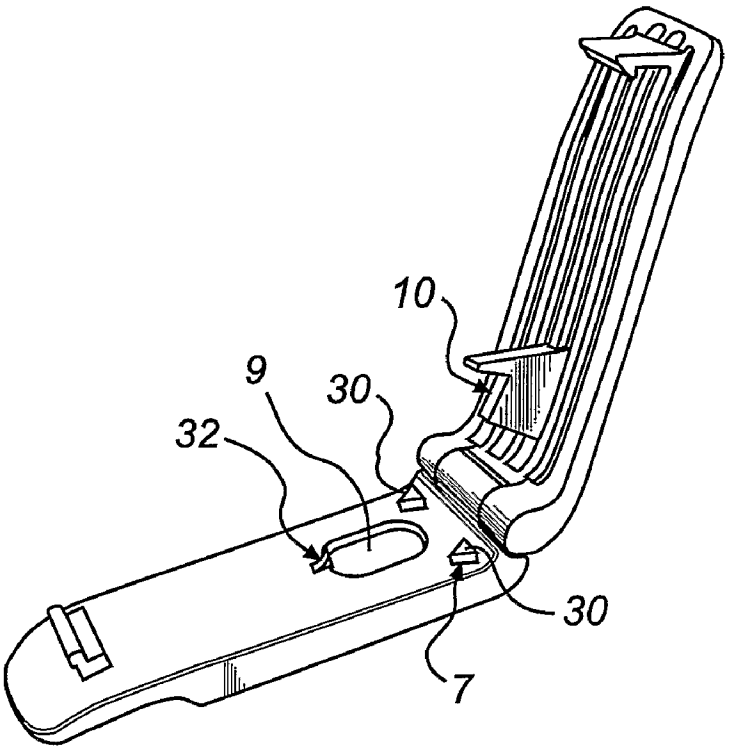
FIG. 3*a* shows a perspective view of a second embodiment of the blister pack device.
Figure 3B:
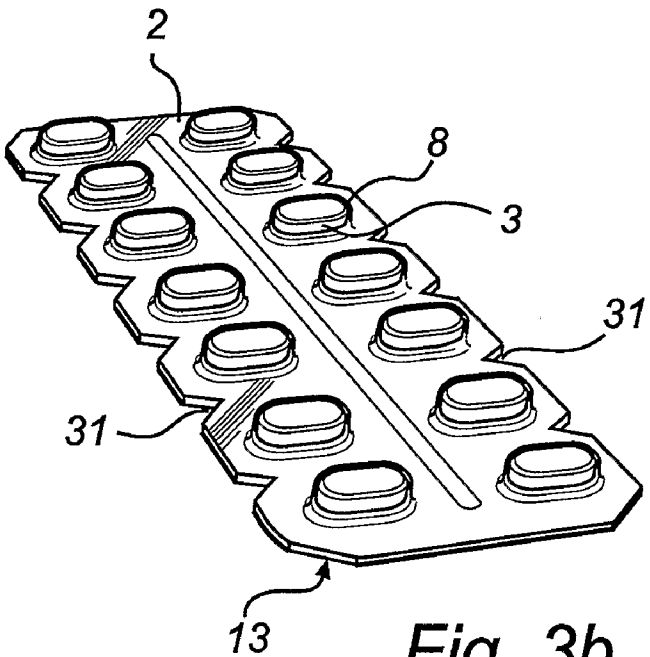
FIG. 3*b* shows a blister pack to be used together with the embodiment of the device according to FIG. 3*a*.

FIG. 3*a* illustrates a second embodiment of the blister pack device in which the guide means 7 comprises at least one projection 30, but preferably two, positioned on each side of the aperture 9 in the first arm. The projections fit into corresponding notches in the blister pack and the blister pack is fixed in a correct position just underneath the protruding member 10. This embodiment of the device is used together with a blister pack provided with notches 31 onto its two long sides corresponding to the projection 30 in size and geometrical form, see FIG. 3*b*. The projections are preferably formed within the material of the first arm. However, they may also be formed as separate items and then attached to s the first arm. In FIG. 3*a* a further embodiment is also shown. A sharp edge 32 is provided near the aperture 9 to initiate a crack or cut in the lid foil 13. If the lid foil is provided with a crack or cut less pressure force is needed to push out a tablet or the like from the blister. Such a sharp edge 32 may also be provided on the device according to any other embodiment of the device described herein.

Figure 4:
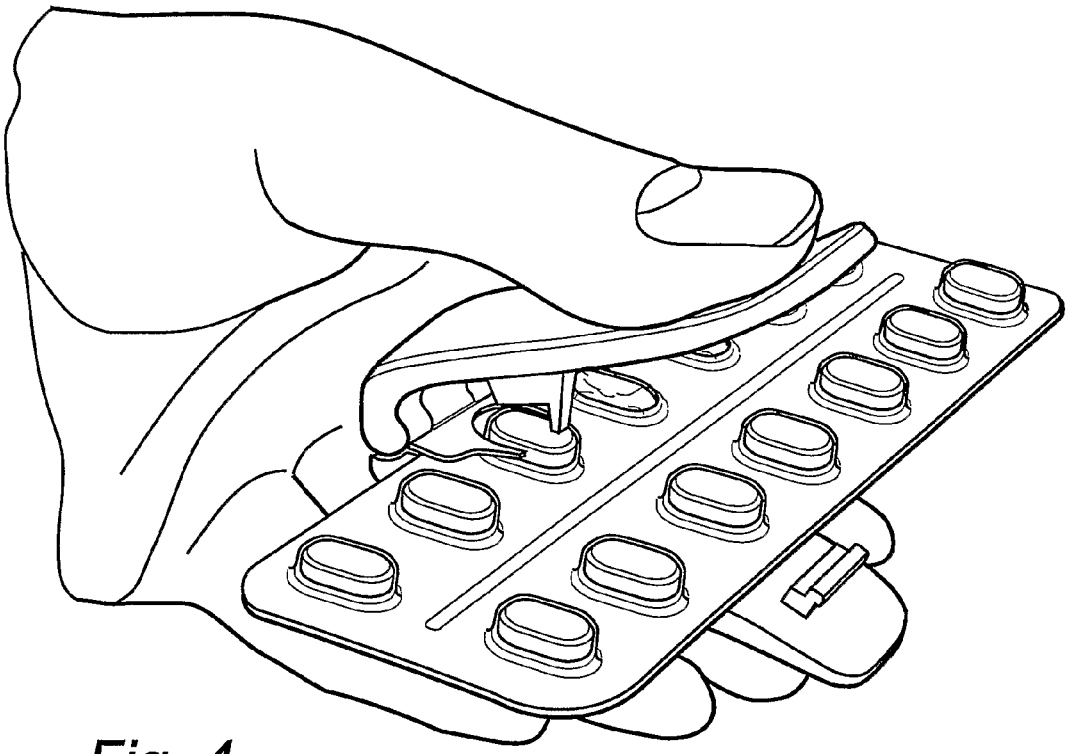
FIG. 4 illustrates the blister pack device in the hand of a user.

FIG. 4 shows how the device is used to press out tablet or the like using only one hand. In this case, the user applies a pressing force with a thumb and as the lever arm is lowered, the protruding member presses out the tablet out from the blister into the user's hand.

Figure 5A:
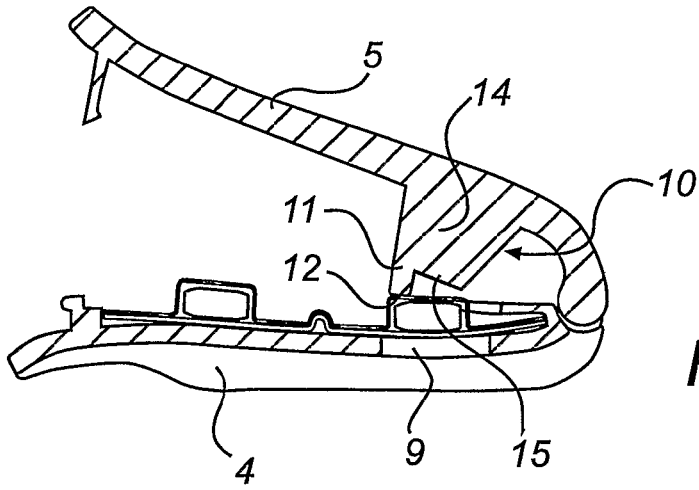
FIGS. 5*a* to 5*c* are illustrative views showing in three steps how a tablet or the like is pushed out from a blister pack using the device.
Figure 5B:
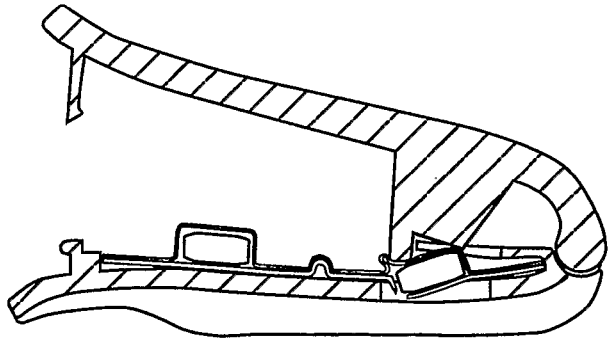
Figure 5C:
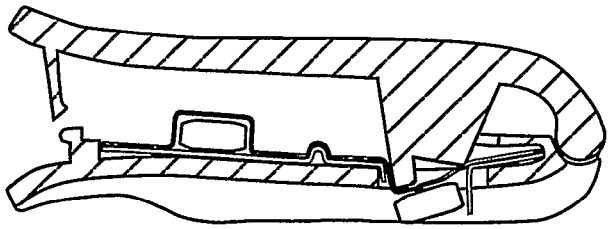

FIGS. 5*a* to 5*c* illustrate in three steps how a dosage unit, i.e. a tablet is pressed out from a blister pack using the device. In FIG. 5*a* the lever arm is lowered and the pointed end 12 of the protruding member 10 is in contact with the blister storing the tablet. In FIG. 5*b* the lever arm has been lowered a little further and a pressing force is now applied to the outer edge of the tablet. The tablet is tilted down and the pressure on the lid foil will increase. As more pressure is applied on the lever arm, the dosage unit is further tilted and the area 15 of the second section 14 of the protruding member will come in contact with the tablet (through the blister) just before the lid foil breaks. This ensures that the pressing force applied onto the tablet is somewhat distributed over the tablet area just before the lid foil breaks, thus as the pressing force reaches it's highest value. Contact is made between the tablet and the area 15 of the second section 14 of the protruding member to avoid that the tablet is damaged or broken due to the high pressing force just before the lid foil breaks. FIG. 5*c* shows how the tablet is easily pressed out through the aperture 9 in the first arm when the lid foil has been broken.

Further, it will be understood that the present invention is not limited to the described embodiments but can be modified in many different ways without departing from the scope of the appended claims.

The invention claimed is:

1. A blister pack device for dispensing a dosage unit from a blister pack, the blister pack having at least one blister and a lid foil, said device comprising:

a first arm and a second lever arm hingedly connected to each other, wherein the first arm has a ledge arranged along each longside and includes an aperture configured to permit ejection therethrough of the dosage unit and the second lever arm includes a protruding member configured to press out the dosage unit from the blister pack when the second lever arm is lowered down onto a blister positioned on the first arm, wherein the protruding member further includes:

a first section configured to apply a pressing force on the dosage unit inside the blister pack to initiate breaking of the lid foil; and a second section configured to distribute the pressing force over the dosage unit and to eject the dosage unit from the blister pack.

2. A blister pack device according to claim 1, wherein the first section is provided with a pointed end arranged in a distal end of the protruding member and configured to apply the pressing force on an outer edge of the blister as the second lever arm is lowered.

3. A blister pack device according to claim 2, wherein an area of the pointed end facing the blister constitutes approximately ¼ of an area of the protruding member facing the blister.

4. A blister pack device according to claim 1, wherein the second section has an area facing the blister for distributing the pressing force over the dosage unit that constitutes approximately ¾ of an area of the protruding member facing the blister.

5. A blister pack device according to claim 1, wherein the protruding member is arranged on the second lever arm such that the second lever arm at least partially fits into the aperture when the second lever arm is lowered onto the first arm.

6. A blister pack device according to claim 1, wherein the first arm includes a guide plate for positioning the blister relative to the aperture and the protruding member.

7. A blister pack device according to claim 6, wherein the guide plate includes a U-shaped indentation at least partly surrounding the aperture for positioning the blister relative to the second lever arm and the aperture.

8. A blister pack device according to claim 7, wherein a gap is provided between the first arm and the guide plate for receiving the blister pack.

9. A blister pack device according to claim 7, wherein the guide plate includes comprises at least one leg at least partly surrounding the aperture and configured to limit movement of the blister relative to the guide plate.

10. A blister pack device according to claim 6, wherein the first arm includes at least one projection arranged to at least partially engage at least one corresponding indentation in the blister pack for positioning the blister relative to the second lever arm and the aperture.

11. A blister pack device according to claim 10, wherein the first arm includes two projections positioned on each side of the aperture.

12. A blister pack device according to claim 1, wherein an edge is provided in the first arm at a distal end of the aperture for initiating a crack in the lid foil.

13. A blister pack device according to claim 12, wherein the edge includes a generally pyramidal shape.

14. A blister pack device according to claim 1, wherein a distance (b) between the protruding member and a distal end of the second lever arm is greater than a distance (a) between the protruding member and the hinge.

15. A blister pack device according to claim 14, wherein a relationship (b/a) between the distance (a) and the distance (b) has a value between about 1.5 and about 5.

16. A blister pack device according to claim 1, wherein the first arm and the second lever arm have substantially the same length.

17. A blister pack device according to claim 1, wherein the device is made out of a plastics material.

18. A method of ejecting a dosage unit from a blister pack using the device according to claim 1, comprising:

positioning a blister of the blister pack relative to the aperture through which the dosage unit is ejectable; and applying a pressing force on the second lever arm such that the dosage unit inside the blister initiates the breaking of a lid foil of the blister pack and is ejected from the blister.

19. A blister pack device for dispensing a dosage unit from a blister pack, the blister pack having at least one blister and a lid foil, said device comprising:

a first arm and a second lever arm hingedly connected to each other, wherein the first arm includes an aperture configured to permit ejection therethrough of the dosage unit and the second lever arm includes a protruding member configured to press out the dosage unit from the blister pack when the second lever arm is lowered down onto a blister positioned on the first arm, wherein the protruding member further includes:

a first section configured to apply a pressing force on the dosage unit inside the blister pack to initiate breaking of the lid foil; and a second section configured to distribute the pressing force over the dosage unit and to eject the dosage unit from the blister pack.

* * * * *